US007086447B2

(12) United States Patent
Garman

(10) Patent No.: US 7,086,447 B2
(45) Date of Patent: Aug. 8, 2006

(54) WINDOW COVERING

(76) Inventor: JoAnn Garman, 8633 N. Mersington Ave., Kansas City, MO (US) 64156

( * ) Notice: Subject to any disclaimer, the term of this patent is extended or adjusted under 35 U.S.C. 154(b) by 8 days.

(21) Appl. No.: 10/942,256

(22) Filed: Sep. 16, 2004

(65) Prior Publication Data

US 2006/0054289 A1 Mar. 16, 2006

(51) Int. Cl.
*A47H 23/00* (2006.01)

(52) U.S. Cl. ..... 160/368.1; 160/84.07

(58) Field of Classification Search ..... 160/19, 160/38, 39, 348, 134, 84.07, 327, 330, 368.1, 160/354, 370.23
See application file for complete search history.

(56) References Cited

U.S. PATENT DOCUMENTS 238,527 A * 3/1881 Replogle ..... 160/38
823,096 A * 6/1906 Armstrong ..... 160/58.1
1,270,518 A * 6/1918 Heller ..... 160/330
1,447,189 A * 3/1923 Leopold ..... 49/41
3,996,987 A * 12/1976 Rodriguez ..... 160/19
5,010,939 A * 4/1991 King ..... 160/84.07
5,074,348 A * 12/1991 Phillips ..... 160/38
5,219,407 A * 6/1993 Herring Lloyd W. ..... 160/330
5,230,375 A * 7/1993 Linder ..... 160/39
6,029,733 A * 2/2000 Xue ..... 160/84.07
6,192,967 B1 * 2/2001 Huang ..... 160/370.23

* cited by examiner

*Primary Examiner*—David Purol
(74) *Attorney, Agent, or Firm*—Shook, Hardy & Bacon, L.L.P.

(57) ABSTRACT

A removable window covering for an arched window is formed of a reinforcing frame and fabric enveloping the frame. The frame has joints to allow for folding of sections of the window covering for ease in transporting and storing the covering. An attachment means is provided to allow for the window covering to be installed over an arched window and easily removed when it is desired to have the window exposed. The window covering may also have UV resistant and thermally insulative properties.

6 Claims, 3 Drawing Sheets

FIG. 3.
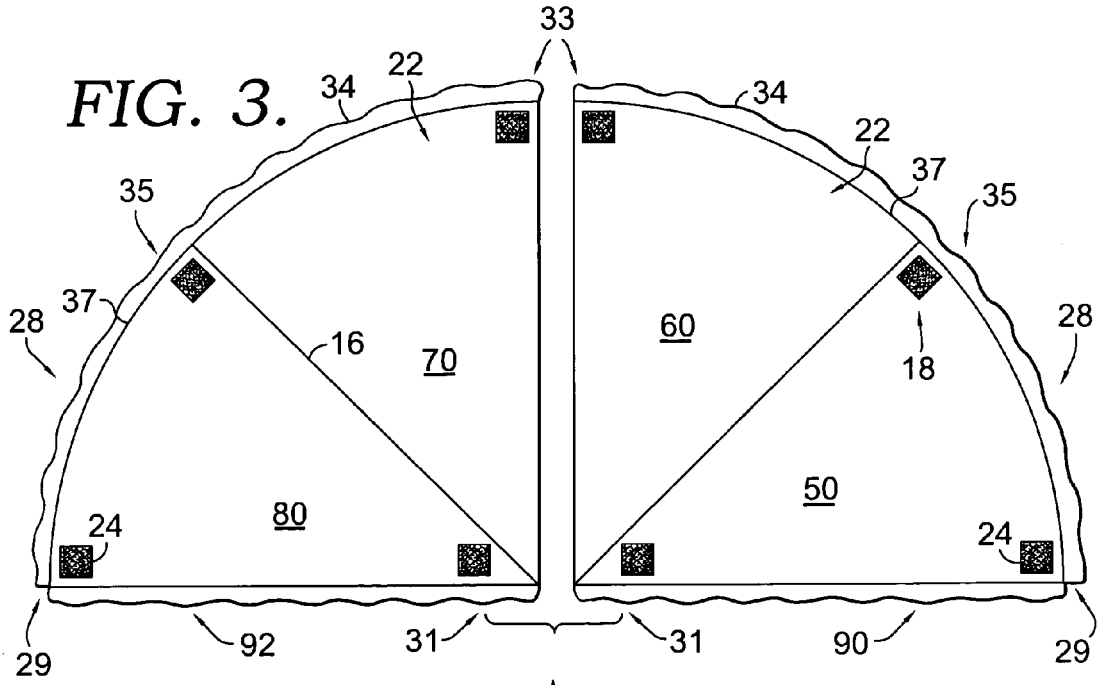
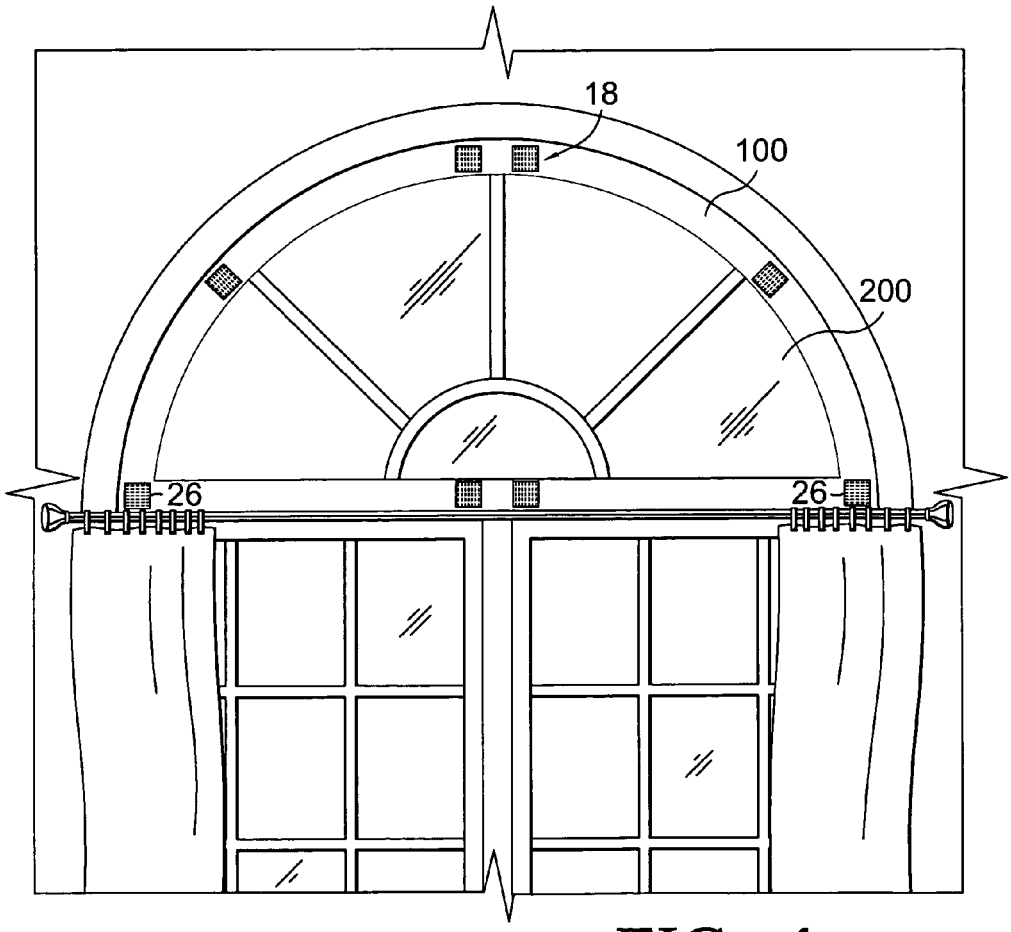
FIG. 4.

WINDOW COVERING

CROSS-REFERENCE TO RELATED APPLICATIONS

None.

STATEMENT REGARDING FEDERALLY SPONSORED RESEARCH OR DEVELOPMENT

Not applicable.

BACKGROUND OF THE INVENTION

Various window coverings have been devised for regulating the amount of light let into a building through a window, and to provide a degree of privacy. Sunlight, in particular, is one form of light that can be both beneficial and undesirable at times. For instance, sunlight can provide solar heating within a room of a building when the light rays are allowed to freely enter through a window. This heating may be desirable in colder seasons when the outside air temperature is rather low, but contrastingly, is undesirable in warmer seasons when the air within a building is constantly being cooled by an air conditioning system. Furthermore, ultraviolet (UV) rays in sunlight can cause damage to various items, including carpets, furniture, etc., when exposed to such UV rays over an extended period of time. Window coverings can thus reduce the exposure to UV rays by substantially blocking their pathway into a building.

One window covering design popular for residential use involves hanging a curtain rod above one or more windows to allow various clips suspending one or more curtains to slid along the rod. Each curtain may be moved manually by pulling the curtain in one direction, or if the curtain rod has a track in which the clips may travel, by pulling on draw cords connected with the clips to slide the same within the track and move the curtain to expose the window. While the typical curtain rod arrangement works well for rectangular windows, for a number of reasons, it is utilized less frequently to cover arch shaped windows typically formed over traditional rectangular windows, as can been seen in the exemplary arrangement in FIG. 1. First, it is difficult to install a curtain rod at a height above such an arch shaped window, which often cannot be accessed without scaling a ladder. Additionally, having essentially "dual levels" of curtain rods—one over the arched window and one over the lower rectangular window—is not aesthetically pleasing, and a curtain long enough to cover both types of windows would not allow for independent light regulation for each window.

Therefore, homeowners and the like often neglect to cover arched windows because of the difficulty in finding and installing an arched window covering that is aesthetically pleasing. While at times they may prefer to leave the arched window uncovered, at other times they could realize energy savings by blocking solar radiation from substantially entering their home and preserve their carpets, upholstery, and other items from UV degradation.

BRIEF SUMMARY OF THE INVENTION

A removable window covering for an arched window is provided. The window covering includes a reinforcing frame having at least one joint, fabric secured around the frame, and attachment means for removable securing of the covering over an arched window. The covering is divided into sections so that it is easily foldable for transporting and storage.

In one aspect, the window covering has four sections and can be separated into two separate pieces each comprising two sections and having a reinforcing frame. The sections of each piece are connected at the joint of the frame allowing the sections to be folded over atop one another. The two pieces each have attachment means, such as hook and loop fasteners (e.g., VELCRO®) positioned therearound for mating with similar attachment means preferably mounted on the casement surrounding the window to allow for installation and removal of the window covering as desired.

The window covering provides many advantages, including being lightweight, aesthetically pleasing, insulative, easy to install and remove, compact, easy to clean, and inexpensive to manufacture.

BRIEF DESCRIPTION OF THE SEVERAL VIEWS OF THE DRAWING

In the accompanying drawings which form a part of the specification and are to be read in conjunction therewith and in which like reference numerals are used to indicated like elements in the various views:

FIG. 3 is a rear elevational view of the window covering of FIG. 1;

FIG. 4 is an illustrative view of the arched window showing the attachment means to which the window covering may be secured;

DETAILED DESCRIPTION OF THE INVENTION

Figure 1:
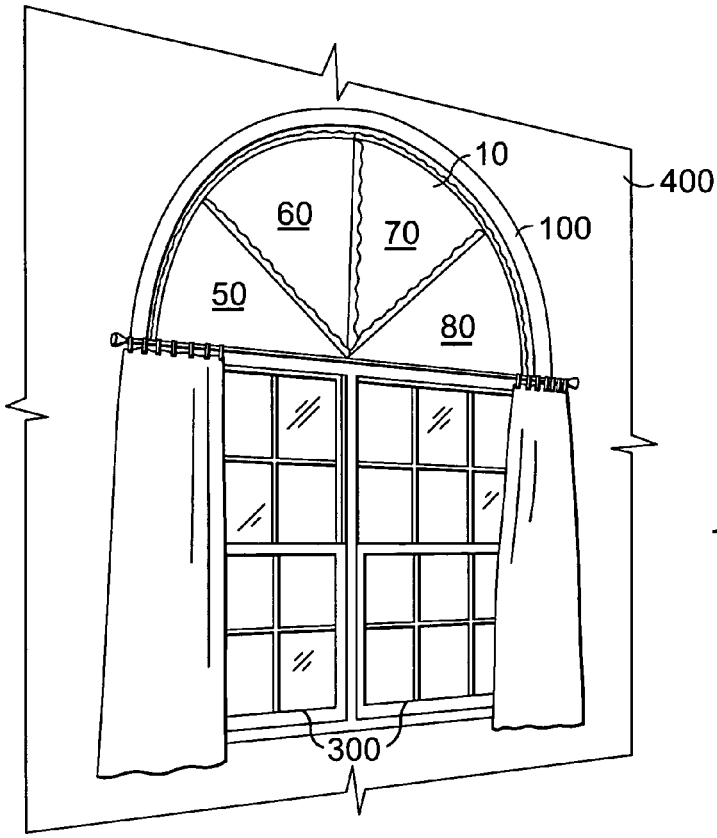
FIG. 1 is an illustrative view showing the window covering of the present invention installed over an arched window and above a set of rectangular windows.
Figure 2:
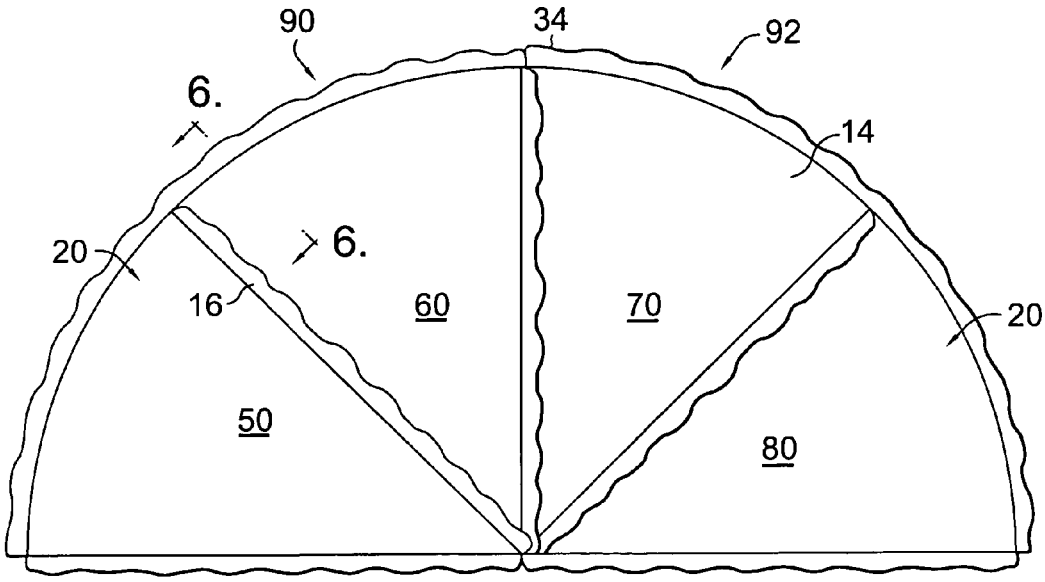
FIG. 2 is a front elevational view of the window covering of FIG. 1.

With reference initially to FIG. 1, a window covering 10 of the present invention is shown installed within an arched window casement 100 to cover an arched window (window 200, FIG. 4) that is surrounded and framed by the casement. The window arrangement shown in FIG. 1, including a set of rectangular windows 300 located below the arched window 200 along a wall 400, is one common window arrangement, but is meant to be exemplary.

As can be seen in more detail in FIGS. 2–6, the window covering 10 is formed of a generally planar semi-rigid or rigid frame 12 surrounded by fabric 14. Preferably, the window covering 10 is divided into four wedge shaped sections 50, 60, 70 and 80 each having a component of the frame 12 therein. In one embodiment, sections 50 and 60, and sections 70 and 80, are secured together along a joint 16 to form sections 50 and 60 into a first component 90 of the covering 10 and form sections 70 and 80 into a second component 92 of the covering 10. Each of the components 90, 92 are independently removably mountable onto the window casement 100 or other structure by an attachment means 18. Also, the window covering 10 has a front side 20 configured to face away from the window and towards the interior of the building and a backside 22 configured to face towards the window and onto which the attachment means 18 is secured.

The frame 12 can be formed of any lightweight material that is fairly rigid, such as cardboard, plastics or very thin plywood, and typically one frame portion is provided for each wedge shaped section 50, 60, 70, 80 to define the overall shape of the respective section. The fabric 14 envelops each frame section and may be, for example, made of natural fibers, synthetics, or a combination of the two. In one arrangement, the fabric 14 may comprise a first general type of material overlaying the front side 20 of the window covering 10, and a second UV resistant material (e.g., high-density polyethylene) overlaying the backside 22 of the covering that may be exposed to direct sunlight through the window. Alternatively, or in addition to having UV resistant characteristics, the second UV resistant material may be a thermally insulative fabric to aid in making the indoor environment less vulnerable to the influence of outdoor temperatures or to sunlight contacting the covering 10.

Attachment means 18 may be in the form of a hook and loop system, such as that commonly referred to under the brand name VELCRO®, where the hook component 24 is secured to one of the window covering 10 and the window casement 100, and the loop component 26 is secured to the other of the covering and casement, as can be seen in FIGS. 3 and 4. The hook and loop components 24, 26 are strategically positioned generally near a perimeter edge 28 of each of the first and second components 90, 92 of the window covering 10—and in matching locations on the window casement 100—to securely hold the covering 10 in place. One suitable configuration is for the attachment means 18 to be located on the window covering at "pressure points", or near a lower outside corner 29, lower inside corner 31, upper inside corner 33, and midpoint 35 of a curved portion 37 of the perimeter edge 28 near the joint 16.

Figure 5:
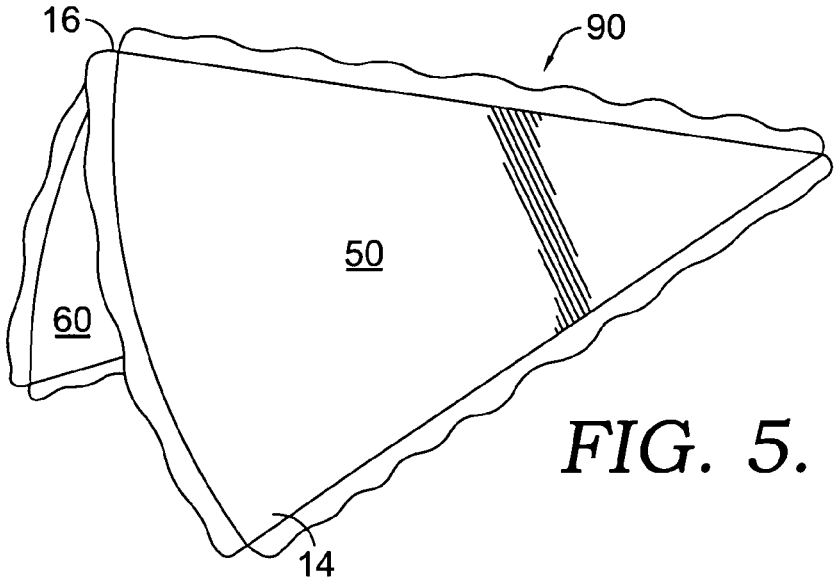
FIG. 5 is a perspective view showing the window covering removed from installation in a partially folded position for storage.

One exemplary fabrication method for the window covering 10 will now be described with reference to FIGS. 2–6. At a first step, the frame 12 is formed into the individual section pieces, one piece for each of the wedge shaped sections 50, 60, 70 and 80 of the window covering 10. The size of the sections 50, 60, 70 and 80 will depend on the size of the arched window 200 and window casement 100, so that preferably the finished window covering 10 will overlap onto the casement for attachment therewith at the locations shown in FIG. 4. For instance, when connected together, the section pieces of the frame can, in one embodiment, overlap one inch with the casement 100. Then, sections 50 and 60 may be connected together to form first component 90, and sections 70 and 80 may be connected together to form second component 92, of the covering 10. Each joint 16 (between sections 50 and 60, and between sections 70 and 80) is formed by a structure that allows one section (e.g., section 50) to be folded over the adjacent section (e.g., section 60) of the respective component (e.g., first component 90) of the covering 10 so that the first and second components 90, 92 may be easily stored and transported when not in use. One partially folded component 90 or 92 is shown in FIG. 5, which upon unfolding to the position shown in FIG. 3 is ready for installation over an arched window 200. The structure of the joint 16 may include, in one embodiment, duct tape or a cloth-like tape that securely holds the sections together while allowing repeated folding of the sections with respect to one another at the joint. For example, the tape may be a light colored (e.g., white) tape so that it is not seen through the fabric that will surround the frame pieces. The tape is preferably applied to the frame pieces on both the front and backsides 20, 22 of the covering 10. The sections 50 and 60, 70 and 80, to form each joint 16, should be spaced slightly apart at their matching edges to allow sufficient clearance for the folding. One spacing dimension found to be suitable in forming the joints 16 is a ⅛ inch gap between sections 50 and 60, and between sections 70 and 80, where the sections are taped together while maintaining the gap to form the first and second components 90, 92. In an alternative arrangement, the joints 16 may be formed instead by mechanical hinges (not shown), one example of which would be a standard door hinge. Such a mechanical hinge would couple the pieces of the frame 12 together that form the first and second components 90, 92 (e.g., couple sections 50 and 60, and sections 70 and 80, together).

Figure 6:
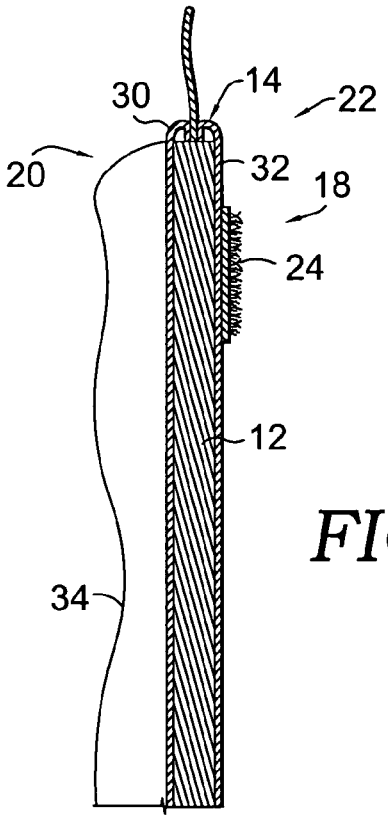
FIG. 6 is a fragmentary side elevational view, partially in section, showing the window covering frame and fabric covering the frame.

The frame 12 forming the foundation for the first and second components 90, 92 of the window covering 10 is then enveloped by the fabric 14. The fabric 14 is preferably sewn over the frame 12 as to surround both frame pieces forming the respective component 90 or 92 of the covering 10. For instance, a first fabric piece 30 overlaying the covering front side 20 may be sewn to a second fabric piece 32 overlaying the covering backside 22. The sewing takes place—for each of the components 90 and 92—around the perimeter of the frame 12 forming the respective components 90 or 92. Other attachment means, such as adhesives or glues may be used instead of sewing to secure the first and second fabric pieces 30, 32 together to envelop the frame pieces only if such adhesives or glues can withstand the elevated temperatures endured by the covering 10 when exposed repeatedly to radiation from incoming sunlight. Optionally, at the time of sewing the first and second fabric pieces 30, 32 together, or thereafter, a fabric ruffle 34 may be sewn around the edges of the sections 50, 60, 70 and 80. FIG. 6 shows how the frame 12 and fabric 14 may be secured together.

Finally, the hook and loop components 24, 26, as attachment means 18, can be secured to the first and second components 90, 92 of the window covering 10 on the backside 22 thereof as described above. In one arrangement, the hook components 24 are sewn (e.g., in 1 inch squares or circles) onto the second fabric piece 32 on the backside 22 of the covering 10, and the loop components 26 are glued or adhered onto the window casement 100 near where the arched window 200 interfaces therewith. However, the location of the hook components 24 and loop components 26 could be reversed, such that the loop components 26 are secured to the covering 10 and the hook components 24 are secured on the casement 100. One suitable adhesive for attaching the loop components 26 is that sold under the name "Perfect Glue 2, Liquid Nails" offered by ICI Paints of Cleveland, Ohio. Other glues or epoxies may also be used.

The window covering 10 may be easily installed over an arched window 200 by unfolding the particular component (first component 90 or second component 92) to be flat, aligning the hook and loop components 24, 26 between the component 90 or 92 and the window casement 100, and pressing the component 90 or 92 against the window casement 100. Then, the other component 90 or 92 is aligned and pressed against the casement 100 over the uncovered part of the window 200 to complete the installation of the covering 10 over the window 200. Because of a degree of rigidity provided by the frame 12, and the lightweight nature of the covering 10, each component 90, 92 can usually be lifted to a high location merely by holding onto a lower portion 36 of the particular component 90, 92. When it is desired to see through the window 200 towards the outdoor environment, or to merely clean the window from the inside, each component 90, 92 may be independently pulled outward to overcome the gripping force of the hook and loop components 24, 26 and remove the covering 10 from attachment with the casement 100. Then each component 90, 92 may be folded at the respective joint 16, as shown in FIG. 5, so that the components 90, 92 may be transported and stored in a compact arrangement.

It should be understood that the window covering 10 may, alternatively, be formed where all of sections 50, 60, 70 and 80 are attached together such that the first and second components 90, 92 become just a single body with another joint 16 formed therebetween. However, this design would have more bulk and weight, which may be noticeable when attempting to mount the covering 10 over the arched window 200. In still another arrangement, the first and second components 90, 92 may be formed of more than four sections (i.e., more than sections 50, 60, 70 and 80). For instance, six sections may be selected such that each of the first and second components 90, 92 may be divided into three sections, and an additional joint 16 would be required for each component 90, 92.

From the forgoing, it can be seen that the window covering 10 of the present invention provides an effective solution for covering an arched shaped window that is also easy to install and remove as desired. Furthermore, since certain changes may be made in the above invention without departing from the scope hereof, it is intended that all matter contained in the above description or shown in the accompanying drawing be interpreted as illustrative and not in a limiting sense.

What is claimed is:

1. A window covering configured for removable attachment over an arched window, comprising:

at least two wedge shaped sections, each section formed of a reinforcing frame covered by fabric and connected with an adjacent section by a joint formed along a common shared edge of the connected sections, wherein the joint allows for folding of one wedge shaped section relative the adjacent section; and attachment means for removably attaching the window covering to a structure to substantially cover the arched window.

2. The window covering of claim 1, wherein the attachment means comprises hook and loop components mounted with the fabric of the window covering and with the structure.

3. The window covering of claim 2, wherein the structure is a window casement.

4. The window covering of claim 1, wherein the at least two sections of the reinforcing frame comprise four or more sections, with at least two sections of the four or more sections forming a first component and at least two other sections of the four or more sections forming a second component, with each of the first and second components including at least one joint, and wherein the first and second components are structurally separate members.

5. A foldable window covering comprising:

first and second components, each of the first and second components including at least two wedge shaped sections, each section formed of a reinforcing frame covered by fabric and connected with an adjacent section by a joint formed along a common shared edge of the connected sections, wherein the joint allows for folding of one wedge shaped section relative the adjacent section; and attachment means for removably attaching the window covering to a surface.

6. The window covering of claim 5, wherein the attachment means comprises hook and loop components.

* * * * *